US005184819A

United States Patent [19]

Desbiolles

[11] Patent Number: 5,184,819

[45] Date of Patent: Feb. 9, 1993

[54] GOLF CLUB

[76] Inventor: Jacques Desbiolles, 20, rue des Jardins, 74000 Annecy, France

[21] Appl. No.: 606,776

[22] Filed: Oct. 31, 1990

[30] Foreign Application Priority Data

Nov. 14, 1989 [FR] France ..... 89 14923

[51] Int. Cl.[5] ..... A63B 53/02

[52] U.S. Cl. ..... 273/80.2; 273/80.8

[58] Field of Search ..... 273/80.1-80.8, 273/167 K, 80 R

[56] References Cited

U.S. PATENT DOCUMENTS

| | | | |
|---|---|---|---|
| 1,829,900 | 11/1931 | Johnson | 273/80.8 |
| 1,994,149 | 3/1935 | Root | 273/167 K |
| 2,007,976 | 7/1935 | Kraeuter | 273/80.2 |
| 2,015,253 | 9/1935 | Buhrke et al. | 273/80.2 |
| 2,299,735 | 10/1942 | Birkhofer | 273/80.8 |
| 2,470,406 | 5/1949 | Matzie | 273/80.3 |
| 2,880,002 | 3/1959 | Wetty | 273/167 K |
| 3,170,691 | 2/1965 | Pritchard | 273/80.5 |
| 3,176,987 | 4/1965 | Johnston | 273/80.2 |
| 3,397,888 | 8/1968 | Springer et al. | 273/80.1 |
| 3,410,558 | 11/1968 | Reuter | 273/80.2 |
| 3,572,709 | 3/1971 | Risher | 273/80.2 |
| 3,759,527 | 9/1973 | Witherspoon | 273/80.2 X |
| 3,825,991 | 7/1974 | Cornell | 273/80.2 X |
| 4,984,794 | 1/1991 | Pernelle et al. | 273/80.2 X |

FOREIGN PATENT DOCUMENTS

| | | | |
|---|---|---|---|
| 282301 | 12/1927 | United Kingdom | 273/80.3 |
| 332354 | 7/1930 | United Kingdom | 273/80.3 |

*Primary Examiner*—Benjamin H. Layno
*Assistant Examiner*—Sebastiano Passaniti
*Attorney, Agent, or Firm*—Pollock, Vande Sande & Priddy

[57] ABSTRACT

This invention relates to a golf club incorporating a head (1, 20, 46) provided in its upper part with a neck (7, 25, 40, 70) to which is attached a shaft (13, 32, 40). The neck is made separately from the head and is fixed thereto with an intermediate ring (9, 30, 52) interposed between them.

7 Claims, 2 Drawing Sheets

FIG.1
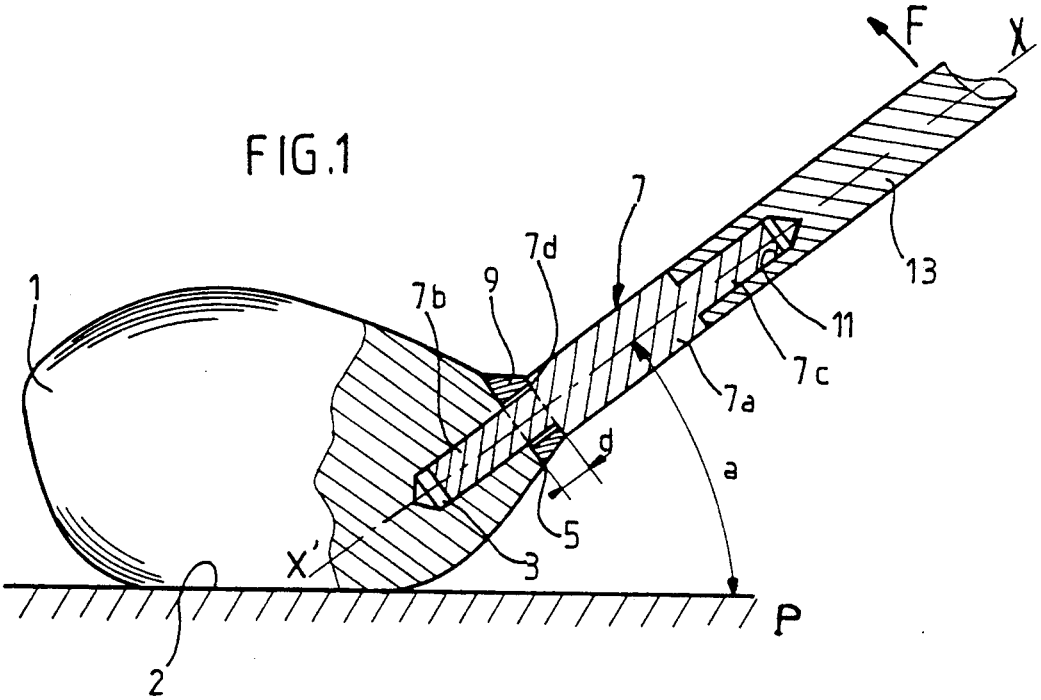
FIG. 2
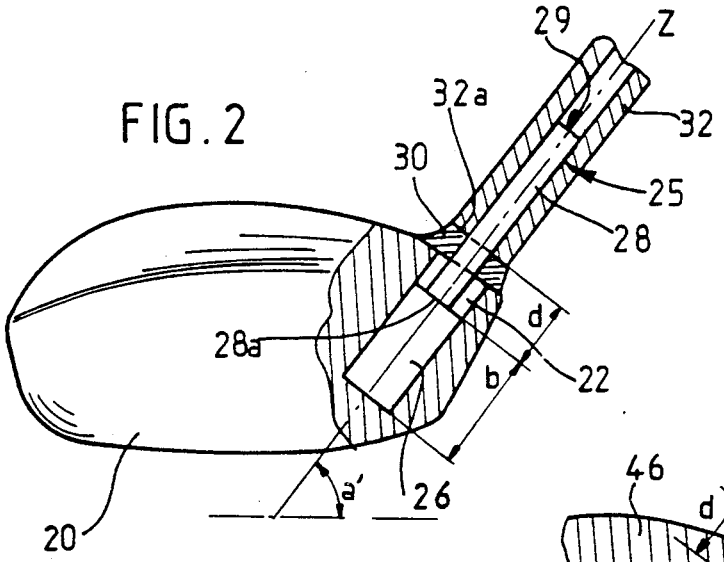
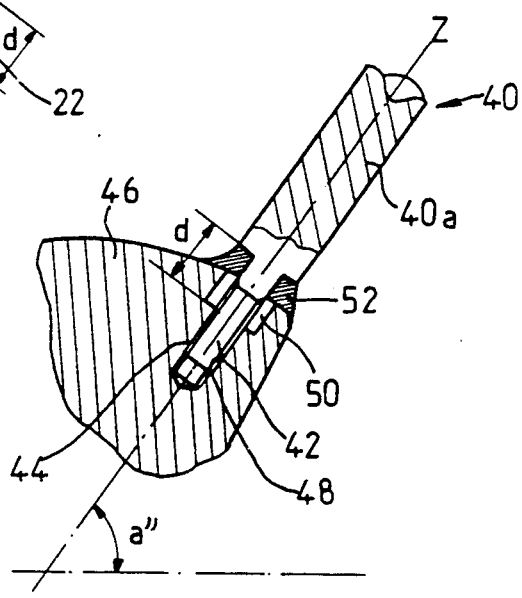
FIG. 3

FIG. 4
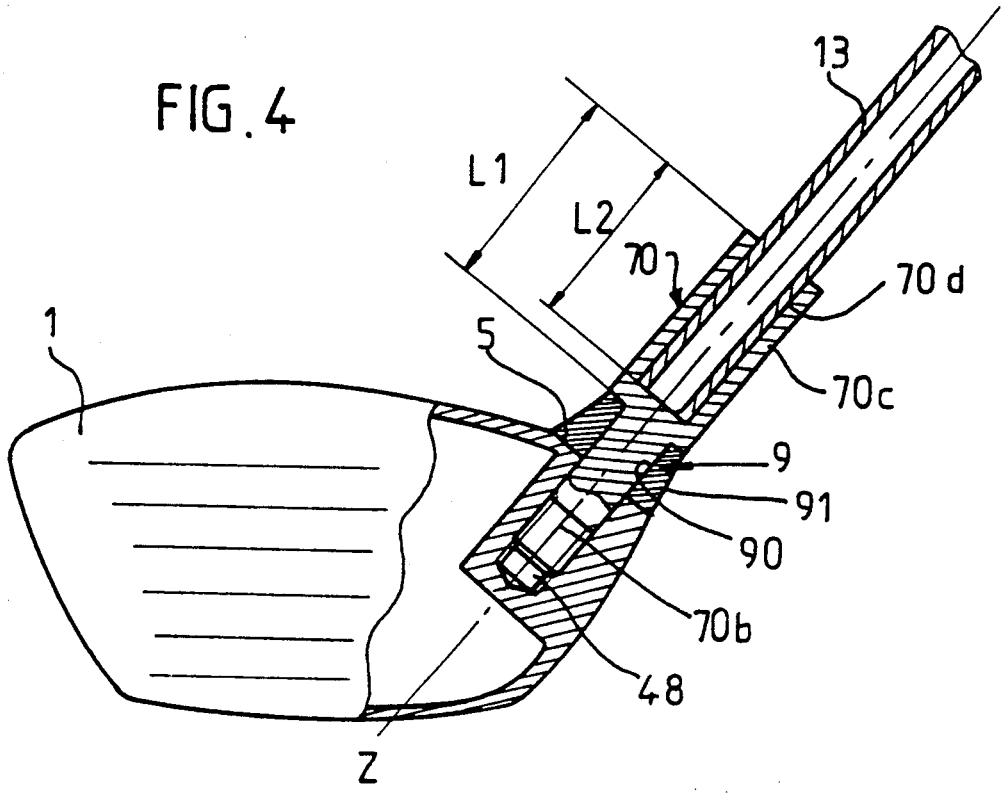
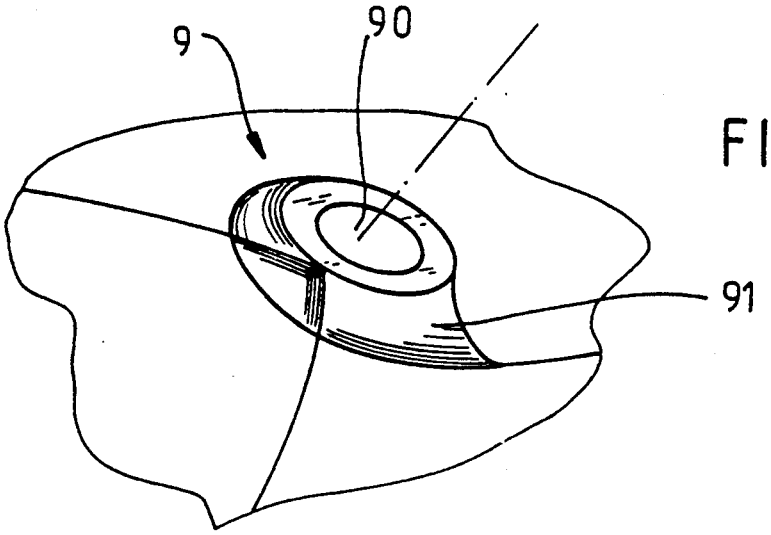
FIG. 5

GOLF CLUB

FIELD OF THE INVENTION

This invention relates to a golf club and more particularly to the attachment of a golf club head to its shaft.

BACKGROUND OF THE INVENTION

It is known that a golf club consists of a shaft, most commonly made of metal, and a head connected to the shaft by means of an upward extension of the shaft usually referred to as the "neck". The head and shaft are generally assembled by inserting the shaft into the neck and bonding it in place, in particular through the use of adhesive. The golf club head forms the striking member proper. In order for it to strike correctly the head should rest substantially flat on the ground when the shaft of the club forms a specific angle with respect to the ground, this angle being the angle called the "lie" of the shaft. It can easily be seen that the angle of "lie" of a golf club varies in relation to the player and essentially depends on the player's grip and height. In the case of a club such as a putter three main values of the angle of lie are generally defined, corresponding to three positions of the player, i.e., three positions of the shaft, namely, a median position and two extreme positions obtained by displacing the axis of the shaft to either side of the median position by about 2°. Attempts have therefore been made, in particular in the case of precision clubs like putters, to make it possible to alter the angle of lie easily in such a way as it can be adjusted to the player's grip.

Various solutions have been proposed to solve this problem, in particular by deforming the neck after a golf club has been assembled. In the case of traditional putters, i.e., putters in which the upper part of the head supporting the neck has a certain flexibility with respect to the head, the deformation is applied in this upper part and is progressively distributed over the length thereof. Conversely, in some putters the upper part of the head has a structure which makes it rigid so that it cannot deform. In this case, the bending force is taken up by the neck exclusively. In order to retain the deformation applied to it in the course of bending, to adjust the angle of lie, the latter must have mechanical properties such that the stresses applied to it are in excess of its elastic limit, so that the material does not resume its original position after deformation, and below its fracture limit, so as to avoid breaking the neck of the golf club.

The head of a golf club is constructed of a material which is selected on the basis of mechanical stresses which are not necessarily the same as those required for the construction of the neck. As a result, the forces applied to the latter in the course of the operation of adjusting the angle of lie are not within the range of the aforementioned mechanical stresses. Thus, if the material forming the head is not sufficiently rigid, the neck will tend to resume its initial position after bending, and if, on the contrary, it is too hard there will be a risk of it breaking during the bending operation. Furthermore, generally for aesthetic reasons, golf club heads are normally provided in their upper part with a connecting portion which is generally conical and tapers from bottom to top in order to provide the connection to the shaft of the club. This connecting part has the disadvantage of interfering with the inclination of the club shaft when it is desired to alter the angle of lie of the latter. In addition, the connecting part forms a protuberance which gives rise to complications during moulding, and may sometimes result in defective products.

In traditional club heads in which the neck is integral with the head, being an extension on a single piece, there are generally defects in concentricity, and therefore defects in alignment, between the shaft and the neck, and these defects may be corrected or at least masked by a conventional part called a ferrule.

SUMMARY OF THE INVENTION

The object of this invention is to overcome the aforementioned disadvantages by providing a golf club whose angle of lie can be adjusted by deformation, by bending the shaft with respect to the head, in which the head is easy to mold and in which the connecting part between the base of the shaft and the top of the head is constructed in an aesthetic manner.

In accordance with the present invention there is provided a golf club comprising a head provided with a neck and a shaft attached to the neck, wherein the neck is made separately from and fastened to the head, and an intermediate ring surrounds a portion of the neck located between the head and a shoulder at the upper end of the neck portion.

BRIEF DESCRIPTION OF THE DRAWINGS

An exemplary embodiment of the invention will be described below with reference to the appended drawings.

FIG. 1 is a view in vertical cross-section of the lower part of a golf club according to the invention.

FIG. 2 is a view in partial vertical cross-section of a second embodiment of a golf club according to the invention.

FIG. 3 is a view in partial vertical cross-section of a third embodiment of a golf club according to the invention.

FIG. 4 is a view similar to FIG. 1, showing a preferred variant.

FIG. 5 is a partial perspective view of the head illustrated in FIG. 4.

DESCRIPTION OF PREFERRED EMBODIMENT

FIG. 1 shows the lower part of a golf club, more specifically a wood which has a head 1 which rests via its substantially planar lower face 2 on a horizontal plane P. The upper part of head 1 is pierced with a cylindrical socket 3 having a longitudinal axis which forms an angle a with the plane P, this angle being the angle of lie of the club. Cylindrical socket 3 opens onto a flat portion 5 on the upper part of head 1. Head 1 of the club also has a neck 7 consisting of a separate part attached to the head 1. Neck 7 consists of a central cylindrical member *7a* which is extended at each of its extremities by coaxial cylindrical pins of smaller diameter, *7b* and *7c* respectively. Pin *7b*, which has a diameter substantially equal to that of cylindrical socket 3, is pressed into and bonded in this cylindrical socket 3. An intermediate ring 9, whose internal diameter is equal to the external diameter of pin *7b*, is located around pin *7b*, and is placed between flat portion 5 of head 1 and the lower shoulder *7d* formed in the transverse plane of attachment between central cylindrical member *7a* and lower pin *7b*. This ring 9 ensures that there is a connection, i.e., a smooth transition, between the upper part of club head 1 and the lower part of neck 7. Shaft 13 of the club is forced onto and bonded with pin *7c*. For this purpose, it is provided with an axial blind hole 11 which opens onto its lower frontal face and in which is engaged pin 7*c* whose diameter is substantially equal to that of hole 11.

The material forming neck 7 may be so selected that, bearing in mind the bending which may be applied thereto in order to adjust the angle of lie a to the correct value, the elastic limit of this material is less than the stresses to which the neck has to be subjected so that it retains its position after bending, and so that the fracture limit of this material is greater than the stresses imposed upon it so as to avoid its breaking.

When a force is exerted on shaft 13 in the direction of arrow F, the part of neck 7 which is subjected to bending stresses is the portion of pin 7*b* lying between the two opposite faces of ring 9, i.e., between flat portion 5 and the lower shoulder 7*d* of cylindrical member 7*a*.

In accordance with the invention, the essential elements forming the golf club, namely, head 1, neck 7 and connecting piece 9, consist of separate elements of simple shape. Thus the head may be easily manufactured by molding, using molds which are themselves easily manufactured.

The bending operation is also made easier because the member providing the connection between the upper part of the head and the base of the shaft, i.e., ring 9, does not oppose bending of the neck because it can be displaced with it.

In order to improve the possibility of bending the neck with respect to the head in order to adjust the angle of lie a to the desired value, the length of the neck subjected to bending may be increased, as illustrated in FIG. 2.

In FIG. 2, the upper part of head 20 of a club has a hollow cylindrical socket 22 having a longitudinal axis zz' inclined at an angle a' with respect to horizontal plane P. The neck 25 of the golf club consists of a cylindrical part 26 of length b, which is shorter than the depth of socket 22, and of a diameter equal to that of the socket, and which is extended upwards by a rod 28 of lesser diameter The cylindrical part 26 of neck 25 is located in the base of cylindrical socket 22, and a ring 30 having an internal diameter equal to the external diameter of rod 28 is placed on this rod 28, the latter receiving shaft 32 of the golf club by hafting and bonding. Cylindrical part 26 of the neck is shorter than socket 22 so as to leave a length d of greater or lesser length between the base 32*a* of shaft 32 and the base 28*a* of rod 28. It has been found that during the bending operation the part of rod 28 which is subjected to bending is that lying between its base 28*a* and the base 32*a* of shaft 32. It has also been found that the greater the length d the lesser are the stresses within neck 25 for a given material and a given bending angle.

This being the case, it is possible, by adjusting length d and also by adjusting the nature of the material forming the neck, to maintain the stresses to which the neck is subjected between the elastic limit of the material and its fracture limit, regardless of the mechanical properties of the material forming the club head.

Obviously, certain points of detail in this construction may be altered within the scope of this invention. Thus, as illustrated in FIG. 3, the neck and the shaft may be constructed as a single piece. In this case, a solid shaft 40 whose lower part 40*a* forms the neck is extended at a lower part by a coaxial rod 42 of smaller diameter having a thread 44 at its extremity. Head 46 of the golf club is pierced by a longitudinal socket 48 having an axis zz' forming an angle of lie a'' with horizontal plane P, this housing 48 opening at the exterior of head 46 into a cylindrical cavity or counterbore 50 of greater diameter. This socket 48 is provided with a thread so that it can receive the threaded portion 42 of shaft 40. A ring 52 having an internal diameter equal to that of rod 42 and an external diameter greater than that of cylindrical cavity 50 is threaded onto rod 42 of shaft 40.

It has been found that the length of the part of the shaft forming the neck which is subjected to bending lies between the upper face of ring 52 and the base of cavity 50.

Thus, with such an arrangement, it is possible by adjusting the depth of cavity 50, to adjust the length of the neck which is subjected to bending, in relation to the nature of the material used to construct the shaft and in relation to the stresses which it is desired to obtain within the latter in the course of the bending by which the angle of lie a'' is adjusted to the desired value.

FIG. 4 illustrates a preferred variant of the invention. In this variant head 1 includes the threaded hole or socket 48 into which is screwed the threaded lower pin 70*b* of a neck 70 whose upper cylindrical part 70*c*, of greater diameter than pin 70*b*, includes a smooth axial hole 70*d* designed to receive the lower part of shaft 13. As in the previous embodiment, an intermediate ring 9 is placed around pin 70*b* and is located between the flat portion 5 on head 1 and the shoulder formed at the connection of upper cylindrical part 70*c* of the neck and pin 70*b*. For this purpose, intermediate ring 9 has an axial hole 90 of whose diameter is equal to that of pin 70*b*, and it has a generally tapering shape, as may be seen more specifically in FIG. 5. The outer face 91 of intermediate ring 9 is such that its shape and curvature provide a continuity of shape and curvature between neck 70 and head 1. In accordance with an advantageous arrangement, the depth L2 of axial hole 70*d* in upper cylindrical part 70*c* is less than or equal to the length L1 of the upper part 70*c* of neck 70. Advantageously, the lower part is screwed into the head, but it may also be simply set and bonded into it, as illustrated in FIG. 1. Ring 9 is advantageously constructed of plastic material.

I claim:

1. Golf club comprising:

(a) a head having a socket therein;

(b) a cylindrical neck non-unitary with said head and attached to said head; and (c) a shaft attached to said neck;

(d) said neck comprising an upper end part engaged coaxially with a lower part of said shaft and a lower end part partially engaged in said socket in said head, so as to leave a remainder portion of said lower end part between a base of said upper end part and a base of said head, said neck being substantially straight longitudinally between said upper end part and said lower end part said remainder portion having a diameter smaller than a diameter of said upper end part;

(e) a distinct intermediate ring having an internal diameter equal to an external diameter of said lower end part of said neck surrounding said remainder portion and located between said base of said head and a shoulder formed adjacent said base of said upper end part of said neck.

2. A golf club according to claim 1, wherein said upper end part of said neck has an axial hole into which said lower part of said shaft is secured.

3. A golf club according to claim 2, wherein a length of said axial hole is less than a length of said upper end part of said neck above said intermediate ring.

4. A golf club according to claim 1, wherein said upper end part of said neck includes a pin inserted into said shaft.

5. A golf club according to claim 1, wherein said intermediate ring has a generally tapering external shape and includes an axial hole in which said neck is engaged with a close fit.

6. A golf club according to claim 1, wherein an outer peripheral surface of said intermediate ring has a form providing a smooth transition between an external surface of said upper end part of said neck and an external surface of said head.

7. A golf club according to claim 1, wherein said upper end part of said neck has a diameter greater than said lower end part of said neck.

* * * * *